US006650241B2

(12) United States Patent
Osborne et al.

(10) Patent No.: US 6,650,241 B2
(45) Date of Patent: Nov. 18, 2003

(54) CHILD SAFETY DEVICE

(76) Inventors: Harold G. Osborne, 36 Delft Dr., Holland, PA (US) 18966; Richard C. Osborne, 83 W. Myrtle Ave., Feasterville, PA (US) 19053; Ilya Kovnatsky, 35 W. Bellwood Ave., Holland, PA (US) 18966

( * ) Notice: Subject to any disclaimer, the term of this patent is extended or adjusted under 35 U.S.C. 154(b) by 0 days.

(21) Appl. No.: 09/747,406

(22) Filed: Dec. 22, 2000

(65) Prior Publication Data

US 2001/0030607 A1 Oct. 18, 2001

Related U.S. Application Data

(60) Provisional application No. 60/171,985, filed on Dec. 23, 1999.

(51) Int. Cl.[7] ..... G08B 23/00

(52) U.S. Cl. ..... 340/573.1; 340/531; 340/539; 340/568

(58) Field of Search ..... 340/573.1, 531, 340/539, 568

(56) References Cited

U.S. PATENT DOCUMENTS 4,136,338 A 1/1979 Antenore
4,792,796 A * 12/1988 Bradshaw et al. ..... 340/539
4,898,120 A * 2/1990 Brose ..... 340/573
5,241,923 A * 9/1993 Janning ..... 340/573
5,448,221 A * 9/1995 Weller ..... 340/539
5,620,155 A * 4/1997 Michalek ..... 340/902
5,652,569 A * 7/1997 Gerstenberger et al. .... 340/573
5,745,037 A * 4/1998 Guthrie et al. ..... 340/539

* cited by examiner

*Primary Examiner*—Daniel J. Wu
*Assistant Examiner*—Hung Nguyen
(74) *Attorney, Agent, or Firm*—Volpe and Koenig, P.C.

(57) ABSTRACT

A perimeter monitoring system intended for the enhanced safety of children includes a receiver communicating with a plurality of transmitters worn by the monitored individuals within a predefined perimeter area surrounded by a perimeter loop antenna. A periodic transmission is sent by each transmitter to the receiver as confirmation that the child is presently within the desired area. The system will alarm the operator and provide an indication identifying any one of the monitored children that either leaves the predefined perimeter or enters a restricted area.

10 Claims, 6 Drawing Sheets

CHILD SAFETY DEVICE

CROSS REFERENCE TO RELATED APPLICATIONS

This application claims the benefit of U.S. Provisional Application No. 60/171,985, filed Dec. 23, 1999.

BACKGROUND

The present invention relates to security systems. More particularly, the invention is directed to a child safety system.

A typical home or commercial security system generally consists of a plurality of different monitoring devices, depending upon the type and extent of protection desired. The monitoring devices include motion sensitive detectors, closed circuit video cameras, light curtains and audio detectors. Motion sensitive detectors and light curtains may be setup to cover a particular area. An alarm will be triggered if movement is detected within the monitoring area. Likewise, audio detectors will monitor for intruders by detecting all sounds within a defined area and activating an alarm if the sounds exceed a predetermined threshold.

Video monitoring devices such as closed circuit cameras are typically installed in areas where direct visual monitoring is difficult or when it is desired to observe several areas from a single location. However, video monitoring devices require constant visual surveillance of the display to determine whether any changes have occurred.

Electronic entry monitoring devices may be installed at all doors, windows or other access points within a home or commercial establishment. These devices utilize a closed current loop, whereby current is continuously circulated through the current loop as long as the door or window remains closed. Upon opening the monitored door or window, the current will be discontinued and the discontinuity triggers an alarm condition.

Although these prior art devices are useful for many applications, they may not be suitable in certain circumstances. For example, to implement a security system for children, such as in a daycare center to monitor whether children leave a predefined area or enter a restricted area, if only electronic entry monitoring devices or motion sensitive devices are used, an alarm will be triggered even if an adult or teacher opens a monitored door or enters a monitored area. There is a need for a system to enhance the security and safety of a daycare center or a home environment to monitor the whereabouts of every child.

U.S. Pat. No. 4,136,339 to Antenore discloses a perimeter alarm apparatus that includes a loop of wire to be placed around an area, and electrical circuitry which is connected to the loop to monitor a mobile signal sender within the loop. This system is designed to monitor one signal transmitter within the loop. Although the system may be modified to monitor more than one transmitter, it is necessary to duplicate the RF circuit tuned to the respective transmitter frequencies. This prior art design can only monitor a very limited number of transmitters because each transmitter, and thus each receiver, requires its own frequency range. It is costly and impractical to repeat circuitry for each additional transmitter. Moreover, the prior art does not disclose how to switch between the monitoring of different frequencies transmitted by different transmitters.

SUMMARY

It is an objective of the present invention to enhance the safety of children in a predefined area, whereby each child can be individually monitored.

This and other objectives are achieved by providing a system having receiver communicating with a plurality of transmitters attached to target objects within a predefined perimeter area surrounded by a perimeter loop antenna. The system includes a scheme for identifying individual transmitters and for processing the detection of multiple identification signals sent therefrom. The system will alarm the operator if one of the monitoring objects either leaves the predefined perimeter or enters a restricted area.

DETAILED DESCRIPTION OF THE PREFERRED EMBODIMENTS

Figure 1:
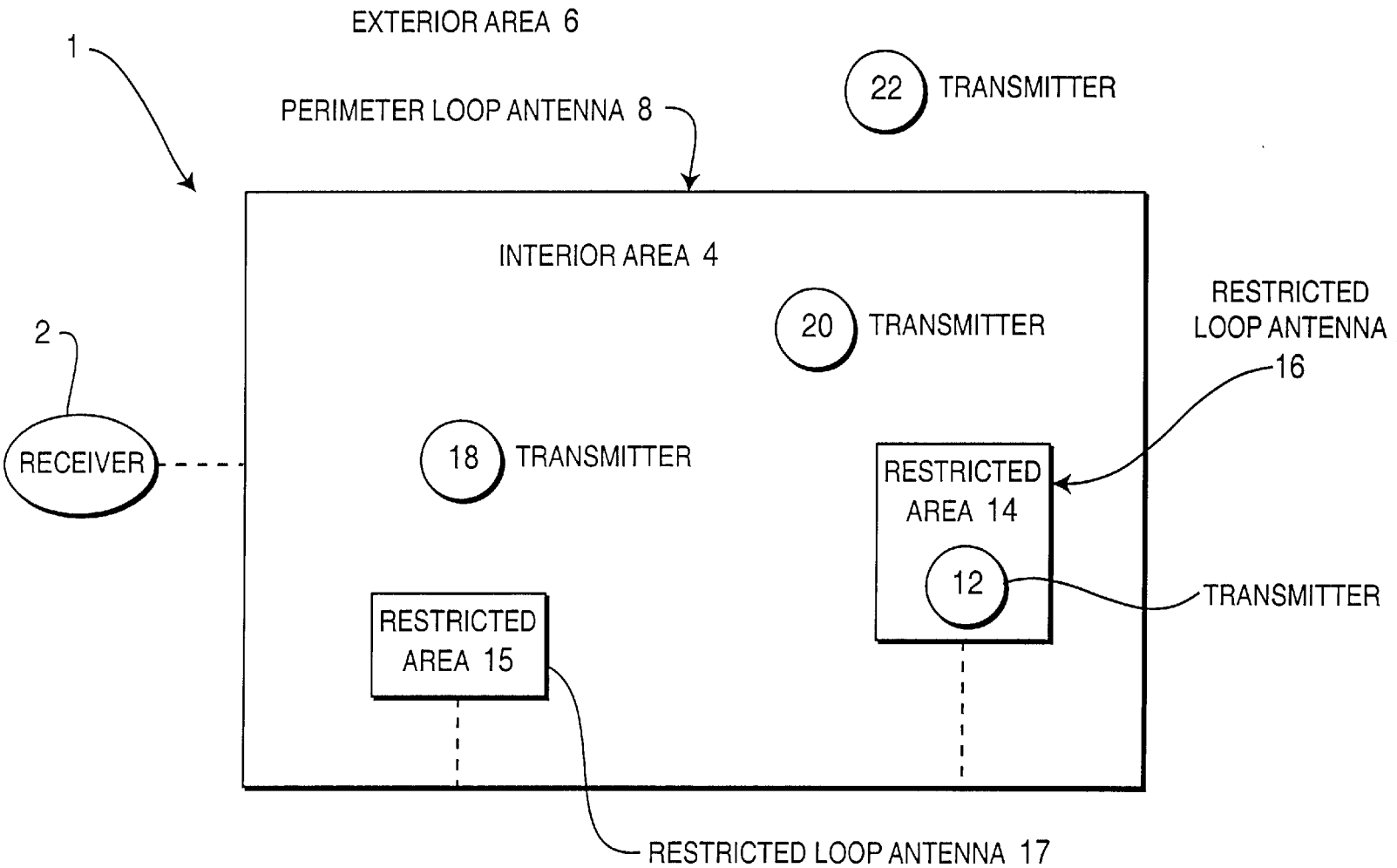
FIG. 1 is a perspective overview of a system made in accordance with the present invention having at least one transmitter and a receiver.

The preferred embodiment will be described with reference to the drawing figures wherein like numerals represent like elements throughout.

An overview of a monitoring system 1 embodying the present invention is shown in FIG. 1. The monitoring system 1 generally comprises one or more receivers 2, which are in communication with a plurality of transmitters 12, 18, 20 and 22 via a perimeter antenna loop 8. The perimeter loop 8 defines an interior area 4 and an exterior area 6, and separates the interior area 4 from the exterior area 6. The perimeter loop 8 is an RF receiving antenna, which receives all RF signals transmitted from the transmitters 12, 18, 20, 22. As should be recognized by those of skill in the art, the length of a receiving antenna must be equal to, or longer than, the wavelength of the RF frequency to receive the RF signals.

Preferably the RF frequency band used in the present invention is appropriately 100 Khz. However, this is a design choice which may be changed to suit the particular application. The transmitter antenna is a ferrite core antenna; the receiver antenna comprises one or more loops around the designated perimeter.

A plurality of smaller restricted areas 14, 15 can also be setup within the interior area 4 by surrounding each restricted area 14, 15 with its own loop of wire. Each restricted area loop antenna also functions as a loop antenna 16, 17, hereinafter called a restricted loop antenna. As will be explained in further detail hereinafter, the restricted loop antennas 16, 17 are also connected to the perimeter loop 8.

The perimeter loop 8 receives a periodically-transmitted individually-identifiable low frequency RF signal from each of the transmitters 12, 18, 20, 22 and forwards these signals to the receiver 2. The receiver 2 will receive no signals (or weaker signals) transmitted by a transmitter from the exterior area 6 because the magnetic field of the transmitters within the perimeter loop 8 will induce voltage in the perimeter loop 8 that will cause the current to flow in the loop in a direction tending to set up an opposing magnetic field. The induced voltage in the perimeter loop 8 is reduced if the transmitter is outside the perimeter loop 8, such as transmitter 22.

Figure 5B:
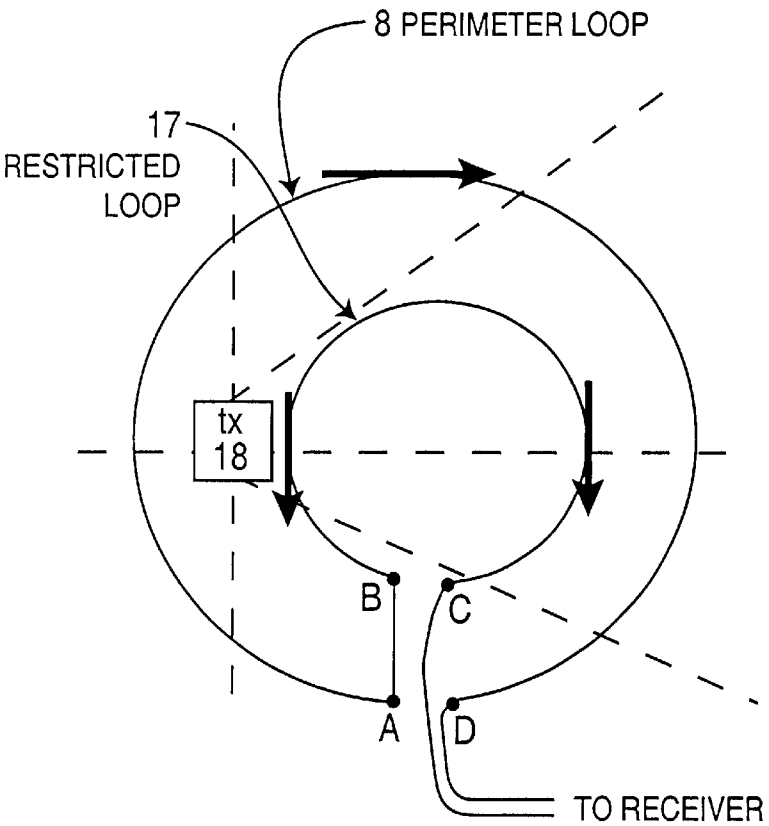
FIGS. 5A and 5B are diagrammatic views of the transmitter flux lines relative to the perimeter and restricted loops.
Figure 5A:
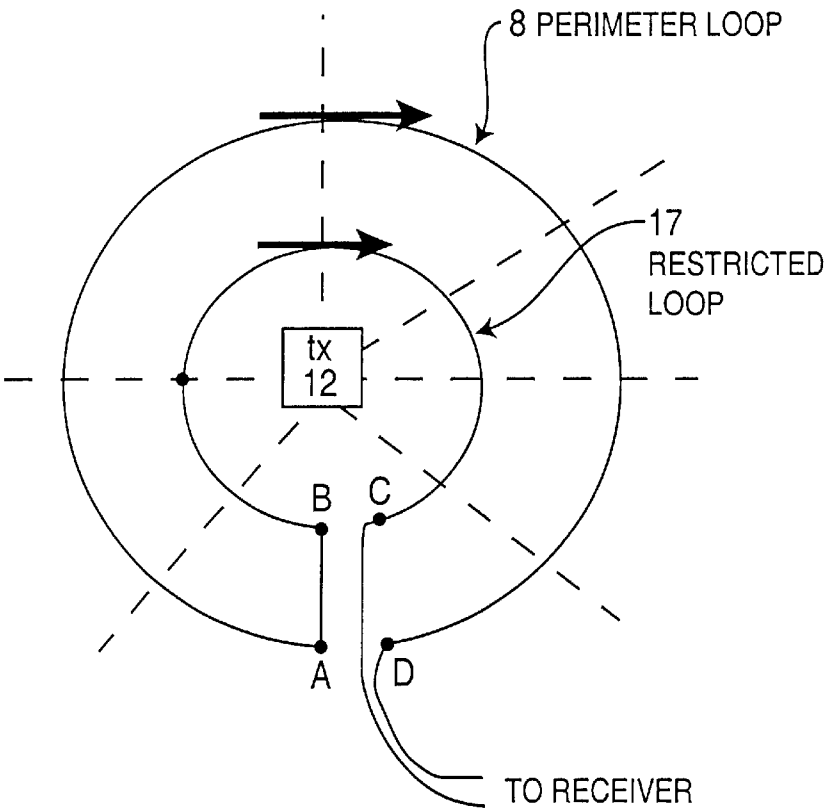

For example, as shown in FIG. 5A, a transmitter 12 in the center of both perimeter loop 8 and one of the restricted loops 17 is transmits a signal which induces current in the restricted loop 17, as well as the perimeter loop 8. The induced current will be perpendicular to the field, (dashed lines). Due to the location of the transmitter 12, the currents induced in the loops 8, 17 are clockwise since the fields are oriented in the same direction. If point A is connected to point B, the currents between two loops 8, 17 cancel each other. Therefore, the receiver 2 will receive no signals transmitted by a transmitter 12 that has entered a restricted area 14, 15. On the other hand, if the transmitter 18 is located outside one of the restricted loops 16, 17 but within the perimeter loop 8, as shown in FIG. 5B, the restricted loops 16, 17 will detect a signal having a very small magnitude because the current within the restricted loop 17 will self-cancel. In essence, one half of the restricted loop 17 will have current induced in one direction while the other half of the restricted loop 17 will have current induced in the opposite direction. Therefore, the signal will come from the perimeter loop 8.

In operation, the transmitters 12, 18, 20, 22 periodically transmit RF signals, each including a unique identification number (UID) to that transmitter 12, 18, 20, 22. Once a transmitter 12 moves from the interior area 4 into a restricted area 12, the receiver 2 receives no signal, (or an extremely weak signal). Concurrently, the receiver 2 continuously receives signals from transmitters 18 and 20 which stay within the perimeter loop area 4. If a transmitter leaves the perimeter area 4 and enters the exterior area 6, such as transmitter 22, the receiver 2 will receive no signal, (or an extremely weak signal), from that transmitter 22. Based upon the presence or absence of a signal from each transmitter 12, 18,20, 22, the receiver 2 can immediately identify whether any transmitters have left the interior area 4 or entered a restricted area 14, 15, and can also identify which transmitter 12, 18, 20, 22 has done so.

Figure 2:
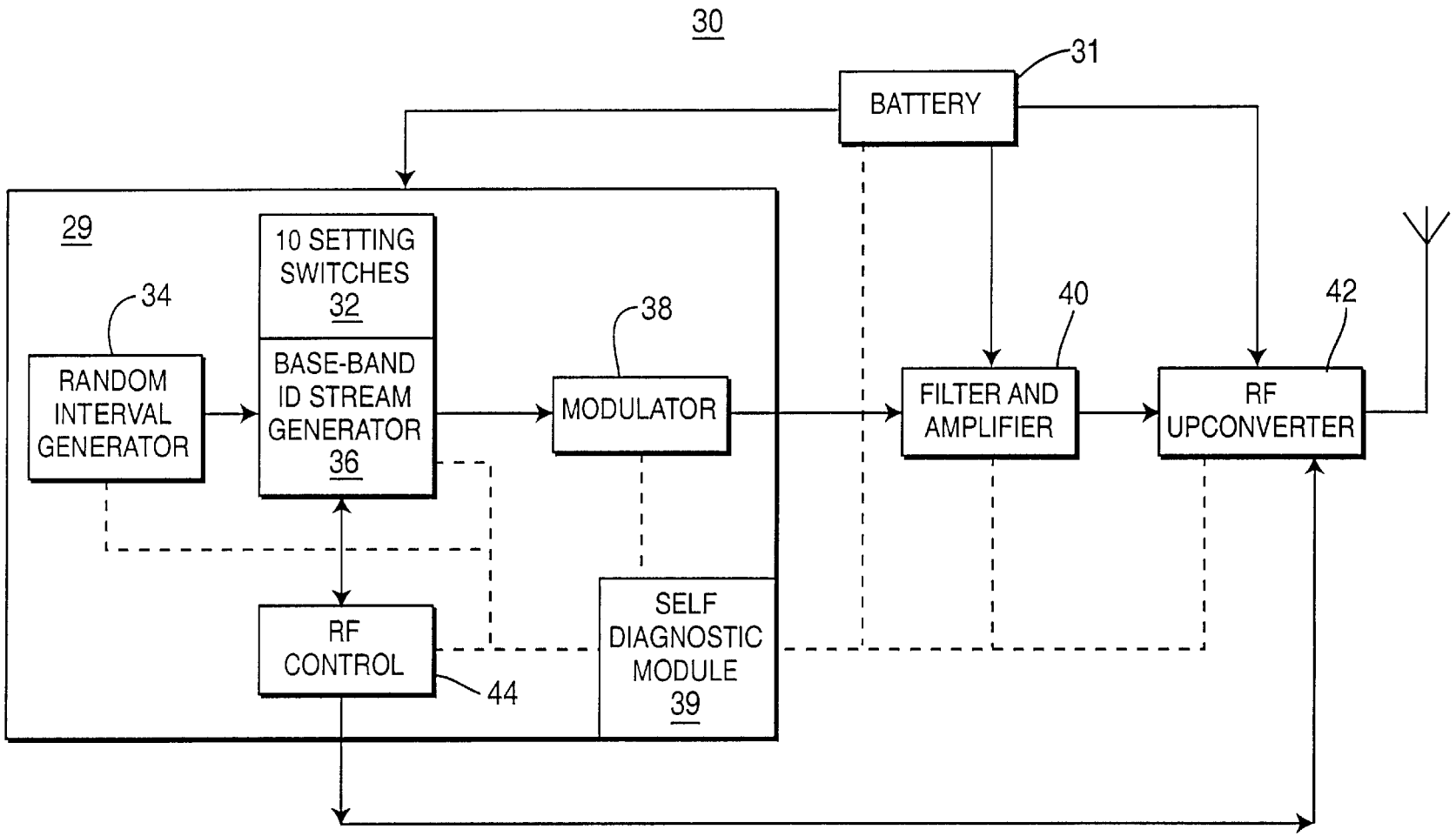
FIG. 2 is a functional block diagram of the transmitter portion of the system of FIG. 1.

A block diagram of a transmitter 30 made in accordance with the teachings of the present invention is shown in FIG. 2. Preferably, the transmitter 30 is portable, such that it may be incorporated as part of an anklet or otherwise attached to the person to be monitored. The transmitter 30 includes a microcontroller 29, a battery 31, a random interval generator 34, a baseband identification stream generator 36, a modulator 38, a filter and amplifier 40, an RF upconverter antenna system 42, an RF control circuit 44 and a self-diagnostic module 39. The microcontroller 29 also includes a means for setting identification numbers 32. Although this is shown in FIG. 2 as identification setting switches (such as DIP switch), this may also comprise a memory (not shown) which may be selectively programed with a keypad (not shown) to input a specific code desired by the user.

The baseband identification stream generator 36 generates an identification stream, comprising a unique identification number (UID) for forwarding to the modulator 38. The identification stream generator 36 reads the switch settings 32, or receives the identification stored in memory which identifies the particular transmitter 30. The modulator 38 receives the bit stream from the identification stream generator 36 and modulates the bit stream with the desired modulation scheme. As those skilled in the art would appreciate, the modulation scheme may be frequency shift keying (FSK) whereby the transmitter transmits one of two frequencies close together, one of which indicates a 0 and the other a 1. The modulation may also be any other type of known modulation scheme such as on-off keying (OOK), whereby the transmitter transmits a series of on off sequences which indicate a 1 or a 0, or amplitude shift keying (ASK), whereby the transmitter transmits one of two levels of signals indicating a 1 or a 0.

The modulated bit stream is forwarded to the filter and amplifier 40 for filtering and amplifying the bit stream. The RF upconverter 42 upconverts the bit stream to RF for transmission. The antenna controller 44 controls both the power and the frequency at which the antenna 42 transmits.

The random interval generator 34 generates a pulse at a random interval to the baseband identification stream generator 36 to minimize collision between transmissions from multiple transmitters occurring at the same time. Although collisions may occur, the random interval generator 34 ensures that if a collision does occur, the next transmission from each of the transmitters that were involved in the collision should occur at a different time. The pulse output from the random interval generator 34 activates the baseband identification stream generator 36. Each time a pulse is sent from the random interval generator 34 to the baseband identification stream generator 36, the baseband identification stream generator 36 generates a burst identification stream for transmission. Accordingly, the transmitter 30 will transmit periodic bursts, each burst containing only the UID of the particular transmitter. The RF upconverter 42 powers up only when the baseband identification stream generator 36 sends the UID, that is, at random time intervals controlled by the random interval generator 34.

The RF upconverter 42 may comprise a plurality of antennas which would be controlled by the RF control 44. Multiple antennas may be necessary because of the low frequencies that are used. These low frequency signals are highly directional. By using multiple antennas, the transmitter 30 could transmit a sequence of identical signals using successive antennas, thus assuring at least one of the antennas is properly directed.

The transmitter 30 has self-test mode executed by the self-diagnostic module 39, which will sound an alarm if the battery 31 is low or any of the components within the transmitter 30 have malfunctioned. The self-diagnostic module 39 includes an energy storage unit (not shown) such as a back-up battery to ensure that in the event that the transmitter battery 31 is dead or malfunctions, the self-diagnostic module 39 will still be able to generate an alarm signal. Thus, failures, or potential anomalies, at the transmitter 30 will be known by the user of the system.

Figure 3:
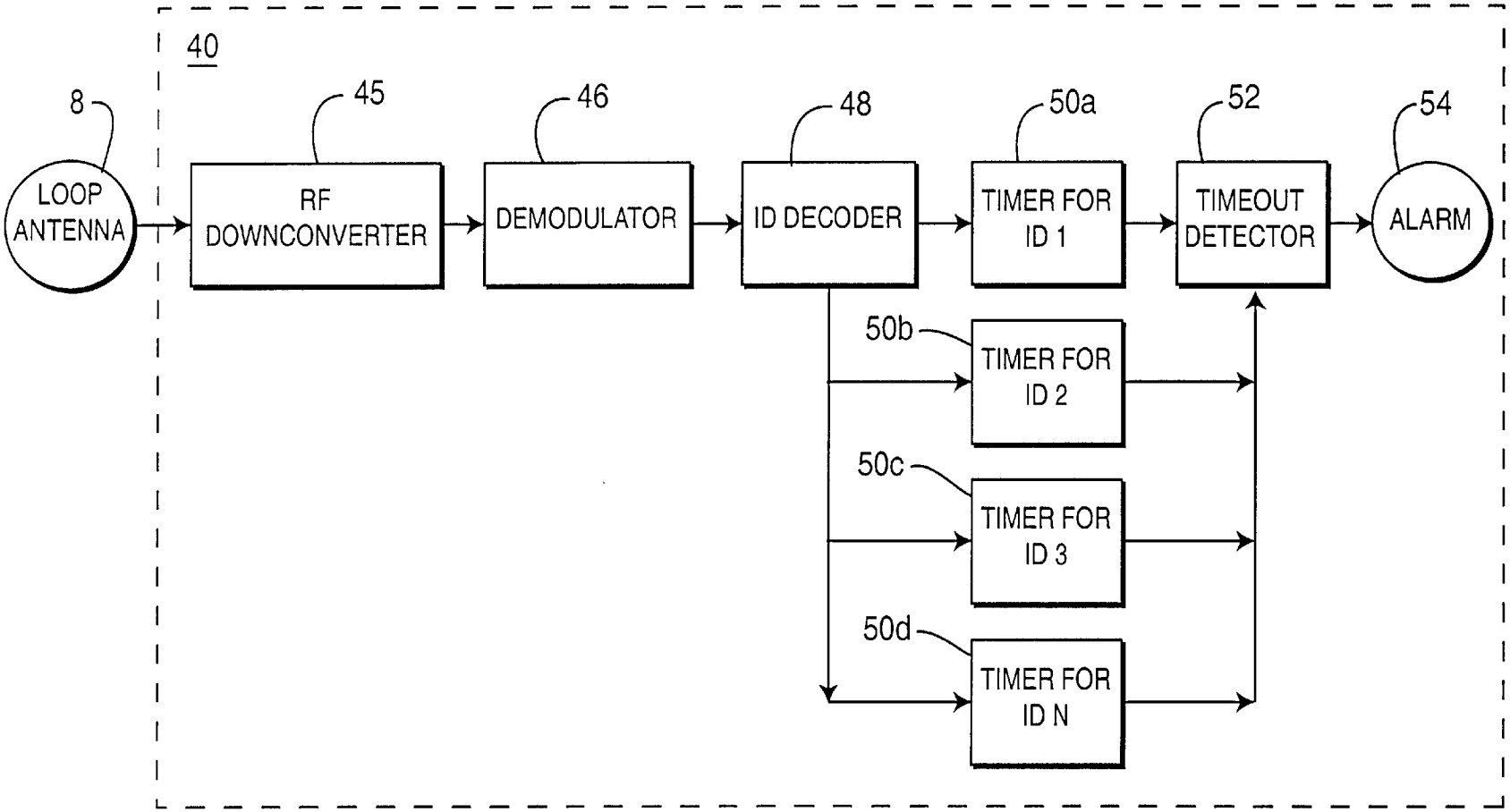
FIG. 3 is a functional block diagram of the receiver portion of the system of FIG. 1.

A receiver 40 made in accordance with the present invention is shown in FIG. 3. The receiver 40 includes an RF downconverter 45, a demodulator 46, an identification decoder 48, a plurality of timers $\mathbf{50}_a$–$\mathbf{50}_d$, a timeout detector 52, and an alarm 54. The receiver 40 receives incoming RF signals from the plurality of transmitters 12, 18, 20, 22 through the perimeter loop antenna 8. The signals are downconverted by the RF downconverter 45 and forwarded to the demodulator 46. The demodulator 46 demodulates the signal and forwards a baseband signal to the ID decoder 48, which reads the UIDs from received RF signals. Collisions are not detected, but are significantly reduced since each transmitter transmits at a random time interval. In the event that a collision occurs between the signals sent from two transmitters, neither signal will be received. However, the likelihood of successive transmissions subsequently colliding again is reduced since the random interval generator 34 within each transmitter will pick a different (i.e., random) time at which to transmit its next signal.

The receiver 40 has a plurality of timers $\mathbf{50}_a$–$\mathbf{50}_d$ and assigns an independent timer $\mathbf{50}_a$–$\mathbf{50}_d$ to each transmitter. All timers $\mathbf{50}_a$–$\mathbf{50}_d$ reset their count to zero when the receiver 40 is initially energized. The count of each timer $\mathbf{50}_a$–$\mathbf{50}_d$ continuously increments until the receiver 40 receives a valid UID for the transmitter 12, 18, 20, 22 corresponding to the particular timer $\mathbf{50}_a$–$\mathbf{50}_d$. When the UID is received and confirmed, the count of the timer $\mathbf{50}_a$–$\mathbf{50}_d$ will be reset to zero. The timeout detector 52 monitors all of the timers $\mathbf{50}_a$–$\mathbf{50}_d$. If a timer $\mathbf{50}_a$–$\mathbf{50}_d$ is not reset and its count exceeds a predetermined threshold, the timeout detector 52 detects the condition of the timer $\mathbf{50}_a$–$\mathbf{50}_d$ and notifies the alarm module 54, which outputs an alarm. Although the operation of the timers $\mathbf{50}_a$–$\mathbf{50}_d$ has been explained with reference to counters, the timers $\mathbf{50}_a$–$\mathbf{50}_d$ may actually measure the amount of time that has elapsed and the timeout detector 52 will detect when a predetermined time limit has been exceeded. The alarm 54 will then be invoked if this predetermined time period has been exceeded.

The UID is first checked for consistency by the ID decoder 48. the UID includes a cyclical redundancy check (CRC) or at least on parity bit in the transmitted data to ensure the UID is received error-free. If the UID passes the consistency check, then the appropriate timer $\mathbf{50}_a$–$\mathbf{50}_d$ based on the received UID is reset to zero.

Figure 4A:
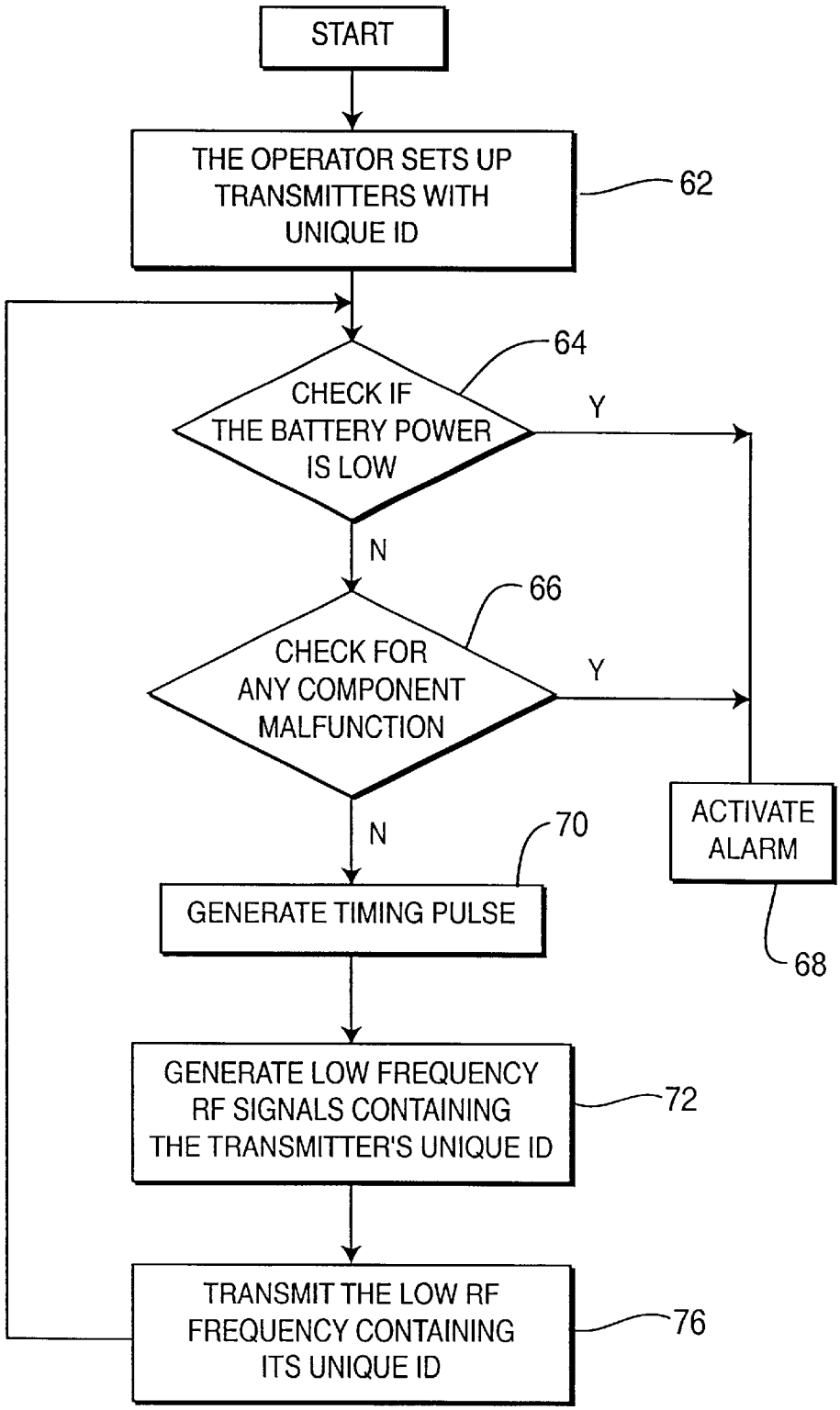
FIG. 4A is a flow diagram of the operation of the transmitter.
Figure 4B:
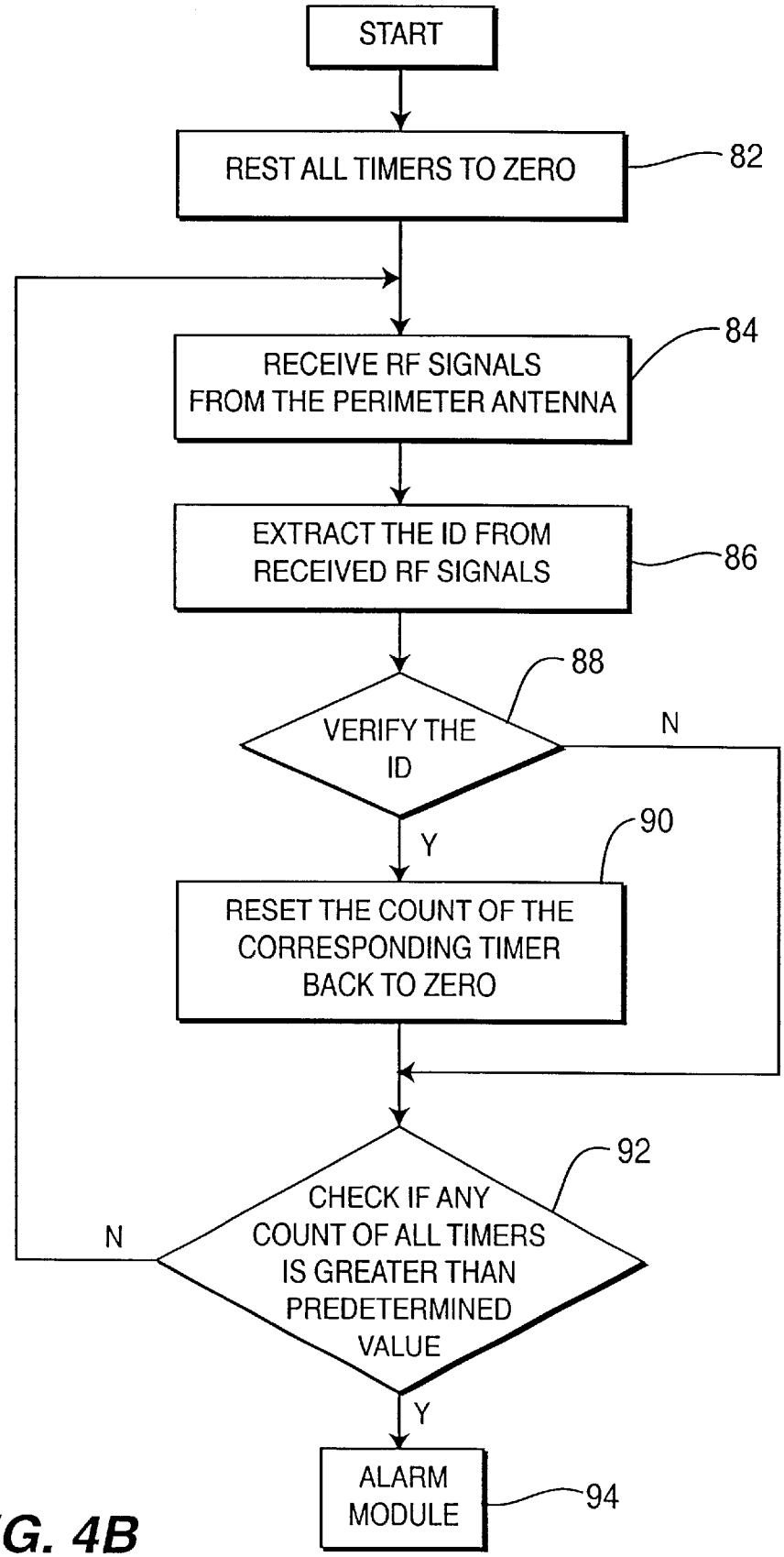
FIG. 4B is a flow diagram of the operation of the receiver.

Referring to FIGS. 4A and 4B, the operation of the system can be explained with reference to at least two concurrent-running modes: 1) the operation of the transmitter 30 as shown in FIG. 4A; and 2) the operation of the receiver 40 as shown in FIG. 4B. Referring to FIG. 4A, the operation of the transmitter begins at step 62 by assigning a UID to each of a plurality of transmitters operating with the same perimeter loop 8. This may be either a manual or automatic task that is typically performed only upon initial energization of the system 1 or when a new transmitter 30 is added. The next two steps 64 and 66 are self diagnosis steps for the self-diagnostic module 39 within the transmitter 30. Step 64 determines if the power of the battery 31 is low. If so, the self-diagnostic module 39 invokes an alarm 68 to report the defective condition. In step 66, the self-diagnostic module 39 monitors all components within the transmitter 30 to determine whether a malfunction occurred, and activates alarm 68 to report any defective condition. At step 70, the random interval generator 34 generates a timing pulse which prompts the baseband identification stream generator 36 to read the switches 32 or memory and generates the UID (step 72). The UID may include a CRC. The transmitter 30 then transmits an RF signal containing the UID (step 76) and transmitter 30 operation cycles back to step 64.

Referring to FIG. 4B, the operation of the receiver 40 will now be explained in detail. The operation of the receiver 40 assumes that the perimeter loop antenna 8 has been deployed along with one or more restricted loop antennas 16, 17, which are optional. Each transmitter is assigned to a corresponding internal timer $\mathbf{50}_a$–$\mathbf{50}_d$ of the receiver 40. At step 82, the receiver 40 resets all its internal timers $\mathbf{50}_a$–$\mathbf{50}_d$ so that each timer count is equal to zero. The receiver 40 receives RF signals from the plurality of transmitters 30 through the perimeter loop antenna 8 (step 84). The received RF signals will be downcoverted and the UID's will be extracted (step 86). Once a received UID is verified (step 88), the internal timer $\mathbf{50}_a$–$\mathbf{50}_d$ corresponding to the verified UID will be reset to zero (step 90). If a timer $\mathbf{50}_a$–$\mathbf{50}_d$ does not get reset for a predetermined time period, or the count of the timer exceeds a predetermined value (step 92) then the alarm module 54 will be invoked at (step 94). Once an alarm is triggered, the operator can be notified that the particular transmitter left the predefined area or entered a restricted area. Finally, the receiver operation cycles back to step 84.

It should be understood that in order to improve the performance of the system, the perimeter loop antenna 8 and the restricted area antennas 16, 17 may comprise two or more loops superimposed upon each other. This will significantly improve the detection of transmitted signals, thereby permitting the system to be installed in larger areas and/or allowing weaker transmitter power. If weaker transmitter power is allowed, battery life of the transmitter will be greatly extended.

While the present invention has been described in terms of the preferred embodiments, other variations which are within the scope of the invention as outlined in the claims below will be apparent to those skilled in the art.

What is claimed is:

1. A perimeter monitoring system for detecting and monitoring the presence of at least one monitored device within at least one perimeter, comprising:

said at least one monitored device comprising:

a transmitter having:

an identification generator for providing a unique identification stream corresponding to said transmitter;

a random interval generator for minimizing collisions of concurrent transmissions from multiple montiored device by aperiodically activating said identification generator at random intervals; and an RF upconverter and at least one antenna for transmitting said unique identification stream as a unique identification signal at the random intervals; and a receiver for detecting at least one monitored device having:

a loop antenna with a conductor situated along at least one perimeter forming the loop;

an RF downconverter for receiving said transmitted signal from the antenna and outputting said unique identification stream;

an identification decoder for detecting said unique identification stream;

at least one timer responsive to said identification decoder and associated with said unique identification stream; and a timeout detector; whereby said timer is reinitialized upon the receipt of said identification stream and said timeout detector produces an alarm signal when said timer reaches a predetermined threshold as an indication that said at least one monitored device is no longer within said at least one perimeter.

2. The system of claim 1, wherein said transmitter further comprises a self-diagnostic module for detecting a defective condition within the transmitter and generating an alarm signal accordingly.

3. The system of claim 1, wherein said antenna comprises a plurality of perimeter loops of wire superimposed upon each other, circumscribing the monitored area.

4. The system of claim 3, wherein said antenna further comprises a plurality of inner loops superimposed upon each other, circumscribing at least one separate monitored area within the perimeter.

5. The system of claim 1, wherein the unique identification stream includes an error check.

6. The system of claim 5, whereby said error check is a cyclical redundancy check.

7. The system of claim 1, whereby said identification generator further includes an identification means for setting unique identification.

8. The system of claim 1, further comprising an antenna controller for controlling power and frequency of said unique identification stream at the RF upconverter.

9. The system of claim 1, whereby the antenna loop creates a path for magnetic current induced by at least on transmitter within the monitored perimeter and where the receiver detects a change in magnetic current once at least one transmitter exits the perimeter to which the timeout detector is responsive.

10. A child motoring system comprising at least one transmitter co-located with each child, for transmitting a unique identification signal, and at least one receiver for detecting said unique identification signal comprising:

the transmitter having:

a randomly activatable identification generator for providing a unique identification stream corresponding to said transmitter at random intervals; and an RF upconverter and antenna for transmitting said unique identification stream as a unique identification signal; and said receiver having:

a loop antenna with a conductor situated along at least one monitored perimeter forming the loop;

an RF downconverter for receiving and RF downconverting said transmitted signal to output said unique identification stream;

an identification decoder for detecting said unique said identification stream and providing an output indicative of the successful receipt of said unique identification stream; and a timing means for intializing upon said indication and for proving an alarm signal when the duration reaches a predetermined threshold.

* * * * *

UNITED STATES PATENT AND TRADEMARK OFFICE

CERTIFICATE OF CORRECTION

PATENT NO. : 6,650,241 B2
DATED : November 18, 2003
INVENTOR(S) : Osborne et al.

It is certified that error appears in the above-identified patent and that said Letters Patent is hereby corrected as shown below:

Column 7,
Line 5, delete "on" and insert therefor -- one --.

Signed and Sealed this

Thirteenth Day of April, 2004

JON W. DUDAS
*Acting Director of the United States Patent and Trademark Office*